US007900773B2

(12) United States Patent
Irish

(10) Patent No.: US 7,900,773 B2
(45) Date of Patent: Mar. 8, 2011

(54) TRAY FOR RECEIVING MUSICAL ACCESSORIES TO BE MOUNTED ON TOP OF AN AMPLIFIER

(76) Inventor: Kent P. Irish, St. John, VI (US)

( * ) Notice: Subject to any disclaimer, the term of this patent is extended or adjusted under 35 U.S.C. 154(b) by 276 days.

(21) Appl. No.: 12/220,209

(22) Filed: Jul. 22, 2008

(65) Prior Publication Data

US 2009/0032480 A1 Feb. 5, 2009

Related U.S. Application Data

(60) Provisional application No. 60/963,143, filed on Aug. 1, 2007.

(51) Int. Cl.
*A47F 7/00* (2006.01)

(52) U.S. Cl. ..... 206/557; 206/561; 211/13.1

(58) Field of Classification Search ..... 206/564, 206/561, 314, 557; 211/13.1, 133.6, 85.6; 248/689, 690; 224/482, 483, 545, 275; 108/46
See application file for complete search history.

(56) References Cited

U.S. PATENT DOCUMENTS

| | | | | | |
|---|---|---|---|---|---|
| 527,108 | A | * | 10/1894 | Cooper | 312/231 |
| 4,843,624 | A | * | 6/1989 | Rashak | 381/91 |
| 4,858,796 | A | * | 8/1989 | Roth | 224/482 |
| 5,019,124 | A | * | 5/1991 | Flugger | 206/564 |
| 5,139,319 | A | * | 8/1992 | Miyai et al. | 312/7.1 |
| 5,269,645 | A | * | 12/1993 | Winski | 156/182 |
| 2006/0133625 | A1 | * | 6/2006 | Adams et al. | 381/120 |

FOREIGN PATENT DOCUMENTS

GB 2251542 A * 7/1992

* cited by examiner

*Primary Examiner* — J. Gregory Pickett
*Assistant Examiner* — King M Chu
(74) *Attorney, Agent, or Firm* — Carter, Schnedler & Warnock

(57) ABSTRACT

A tray adapted to be mounted on the top of a portable amplifier having a handle on the top of the amplifier including a top surface. The top surface is particularly adapted to receive musical accessories. At least one rear wall and two side walls is provided. Each wall is adjacent to the top surface. Each wall has a bottom edge extending below the top surface, forming a cavity. A clip is attached to the tray and received in the cavity. The clip includes a protrusion adapted to be received by the handle of the amplifier for securing the tray to the top of the amplifier.

23 Claims, 6 Drawing Sheets

TRAY FOR RECEIVING MUSICAL ACCESSORIES TO BE MOUNTED ON TOP OF AN AMPLIFIER

RELATIONSHIP TO PRIOR APPLICATION

This is a U.S. nonprovisional application relating to and claiming the benefit of U.S. Provisional Patent Application Ser. No. 60/963,143 filed on Aug. 1, 2007. The entire disclosure set forth in the provisional application is hereby incorporated herein by reference.

FIELD OF THE INVENTION

This invention relates to trays received on the top of amplifiers to enable musicians to store musical accessories therein.

BACKGROUND

A musician often uses an electronic amplifier to broadcast sound to an audience during a performance. In some cases, the amplifier is tilted utilizing a stand or wedge device located under the amplifier to broadcast the sound out and over the audience to provide a clearer projection of the sound. A musician often uses musical accessories, such as small electronic devices, picks and slides, which the musician must have easy access to during the performance. The top of the electronic amplifier is an appropriate place for these musical accessories to rest. However, often these accessories fall off of the top of the electronic amplifier during a performance, sometimes due to vibrations and other times because the amplifier is tilted. It is therefore desirable to provide a means for permitting the musician to use the top of an electronic amplifier to store musical accessories while reducing the likelihood that such accessories will fall off of the top of the amplifier during the performance.

SUMMARY OF THE INVENTION

In accordance with one form of this invention, there is provided a tray adapted to be mounted on the top of a portable amplifier having a handle on the top. The tray includes a top surface. The top surface is particularly adapted to receive musical accessories. The tray includes at least one rear wall and two side walls, with each wall being adjacent to the top surface. Each wall has a bottom edge extending below the top surface, forming a lower cavity. A clip is attached to the tray and is received in the cavity. The clip includes a protrusion which is adapted to be received by the handle of the amplifier for securing the tray on the top of the amplifier.

In accordance with another form of this invention, there is a provided a tray adapted to be mounted on the top of a portable amplifier having a handle on the top. The tray includes a floor having a top surface which is particularly adapted to receive musical accessories. A plurality of walls extend above the top surface of the floor. A clip is attached to the floor. The clip includes a protrusion. The protrusion extends away from the floor. The protrusion is adapted to be received by the handle of the portable amplifier for securing the tray to the top of the amplifier.

In accordance with another form of this invention, there is provided a tray adapted to be mounted on the top of a portable amplifier which has been tilted and which has a handle on the top. The tray includes a floor. A top surface is provided over the floor. The top surface is particularly adapted to receive musical accessories. The tray includes front, rear and two side walls, with each wall being adjacent to the top surface. Each side wall has a bottom edge. At least a portion of the bottom edges are parallel to each other. The top surface is not parallel with the plane formed by the parallel portions of the bottom edges whereby the top surface of the tray is substantially level when mounted on the tilted portable amplifier.

DESCRIPTION OF THE PREFERRED EMBODIMENTS

Figure 1:
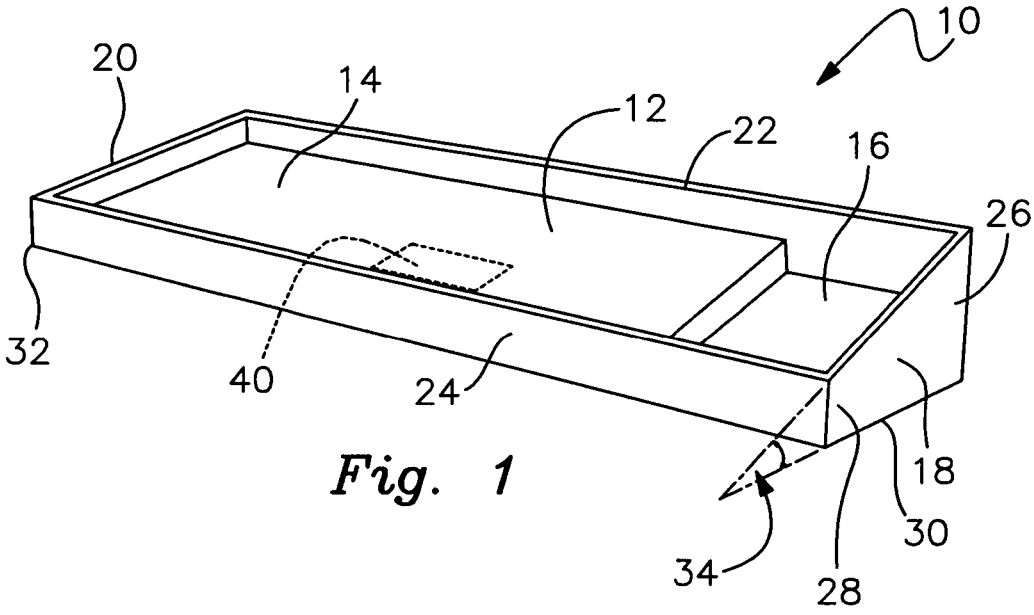
FIG. 1 is a front top perspective view showing one embodiment of the subject invention.

Referring now more particularly to FIG. 1, there is provided a wedge shaped vacuformed tray 10 which preferably is made of ABS plastic. Tray 10 includes top surface 12 which in the embodiment of FIG. 1 is tilted. Preferably top surface 12 includes a layer of non-skid material such as non-skid grit tape constructed of 46 grid aluminum oxide compound with an acrylic adhesive backing for attaching the non-skid layer to the floor of the tray which will be discussed below. Alternatively, a layer of neoprene foam having a textured non-skid top surface with adhesive on the back may be used.

In the embodiment of FIG. 1, top surface 12 includes major surface 14 and minor surface 16. Minor surface 16 is at a lower level than major surface 14. This enables the musician to segregate certain musical accessories from one another.

The tray of FIG. 1 includes side walls 18 and 20 which are identical. The tray includes rear wall 22 and front wall 24. Each side wall has portion 26 which is adjacent to rear wall 22 and portion 28 which is adjacent to front wall 24. The height of portion 26 of side wall 18 and side wall 20 is greater than the height of portion 28 of sides walls 18 and 20. Thus, tray 10 is somewhat wedge shaped. Side wall 18 has bottom edge 30 and side wall 20 has bottom edge 32. Bottom edge 30 and bottom edge 32 are parallel to one other and thus form a plane. The plane of top surface 12 and bottom edge plane form angle 34 which is preferably greater than ten degree (10°) and less than forty-five degrees (45°). Tray 12 is particularly constructed to be used with a tilted amplifier, such as amplifier 36 shown in FIG. 5. Amplifier 36 may be tilted by using a tilt wedge 38 or a stand which is not shown. Wedge 38 may be an amp wedge commercially available from www.ampwedge-.com. Preferably, angle 34 is substantially the same as the tilt angle created by amp wedge 38 so that top surface 12 will be level when tray 10 is mounted on top of amplifier 36.

Figure 2:
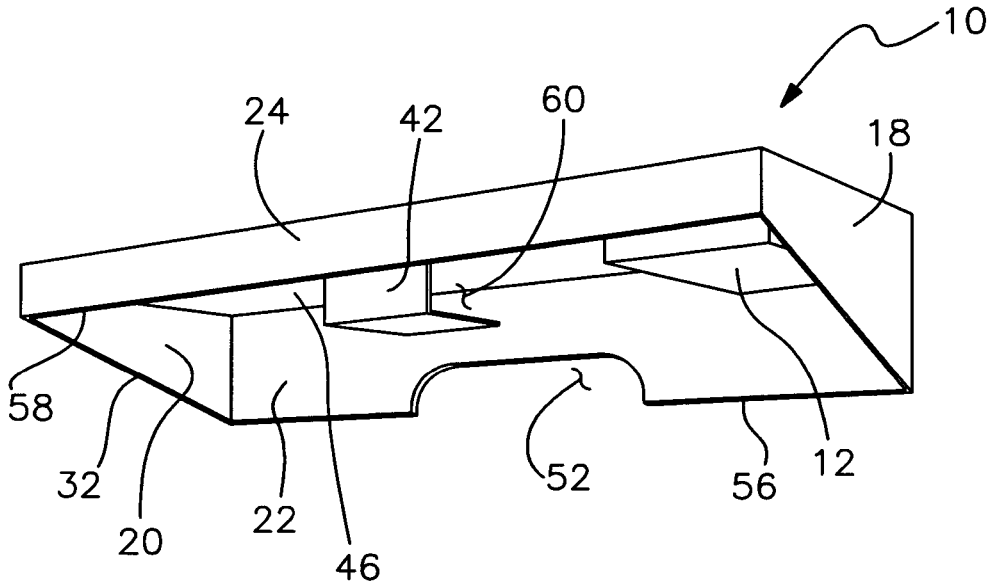
FIG. 2 is a front bottom perspective view showing the embodiment of FIG. 1.
Figure 3:
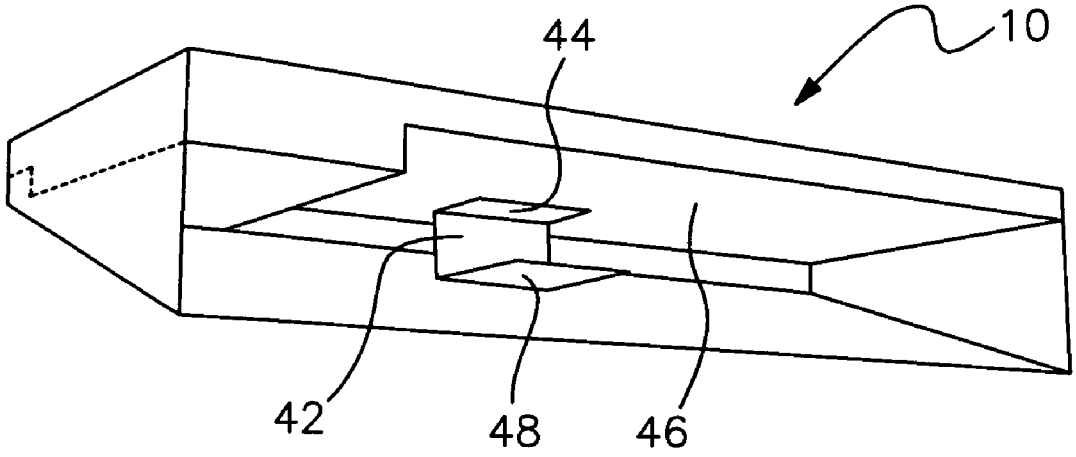
FIG. 3 is a rear bottom perspective view of the embodiment of FIG. 1 with the rear wall removed.
Figure 4:
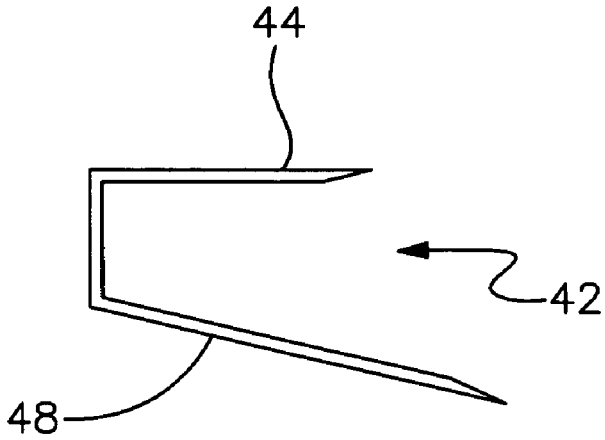
FIG. 4 is a side elevational view of the clip shown in FIG. 3.

The area 40 shown in FIG. 1 shows where clip 42, shown in FIG. 2, is mounted to the bottom of tray 10. Clip 42 includes mounting plate 44 which is attached to floor 46 of tray 10. Floor 46 is situated below top surface 12. Clip 42 includes protrusion 48 which is adapted to be received by handle 50 located on top 52 of amplifier 36. Protrusion 48 extends away from floor 46 at a slight angle. As used herein, the term "attached" means both affixed, such as glued, and integral to. As used herein, the term "accessories" includes small instruments, performance equipment, picks and slides, as well as any other commonly used accessories and items which a musician may need during a performance.

Figure 5:
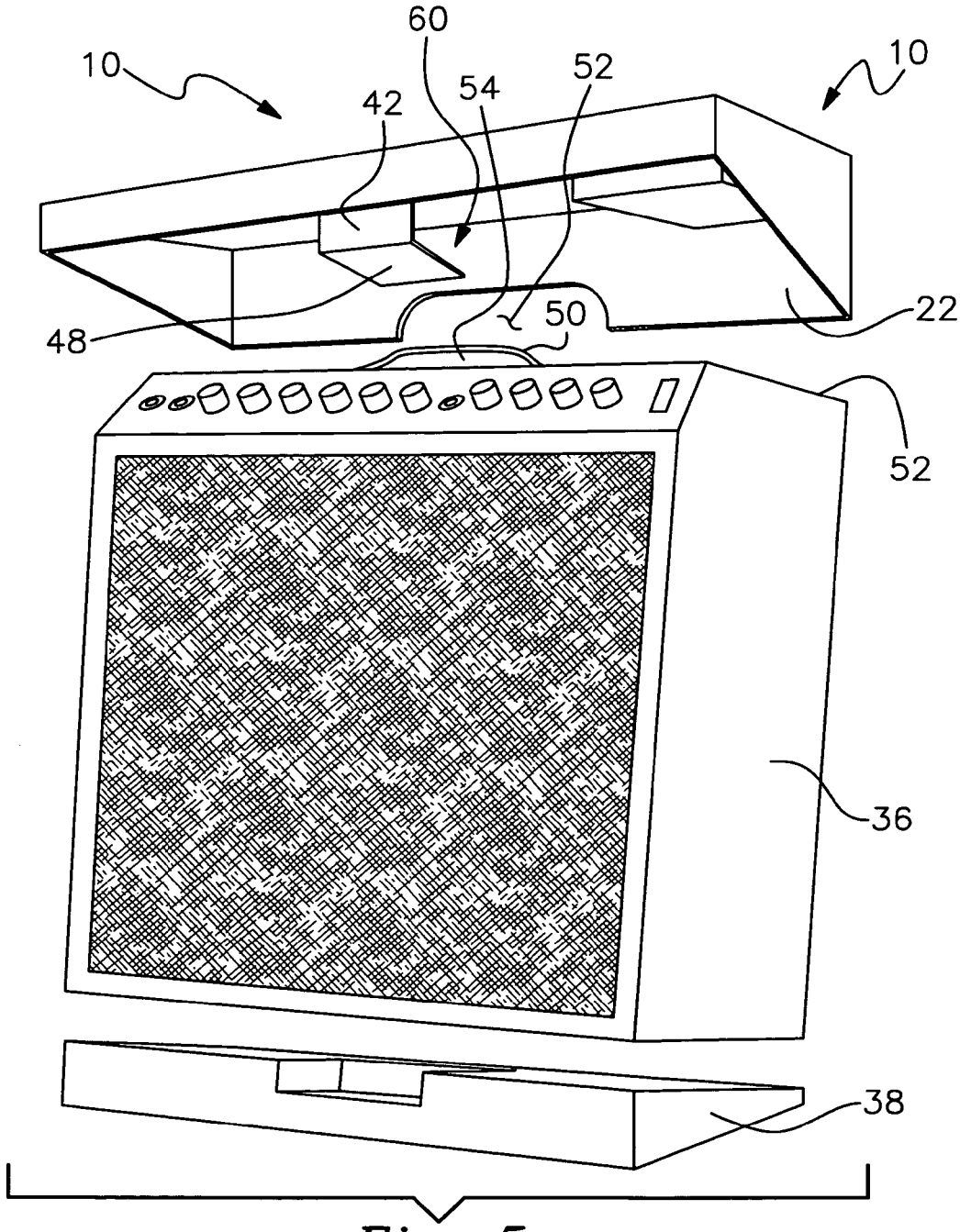
FIG. 5 is a bottom front perspective view showing the tray of FIG. 1 about to be attached to a portable electronic amplifier which has been tilted upwardly.

As shown in FIGS. 2 and 5, rear wall 22 includes cut-out portion 52 which substantially aligns with clip 42. This cut-out portion helps enable the user to insert protrusion 48 into loop 54 created by handle 50 so as to readily secure tray 10 on top 52 of amplifier 36. Rear wall 22 has a lower edge 56 and front wall 24 has a lower edge 58. The lower edges 30 and 32 of side walls 18 and 20 and lower edge 56 of rear wall 22 and lower edge 58 of front wall 23 all extend below top surface 12 as well as floor 46, forming cavity 60. Clip 42 is therefore received in cavity 60.

Figure 6:
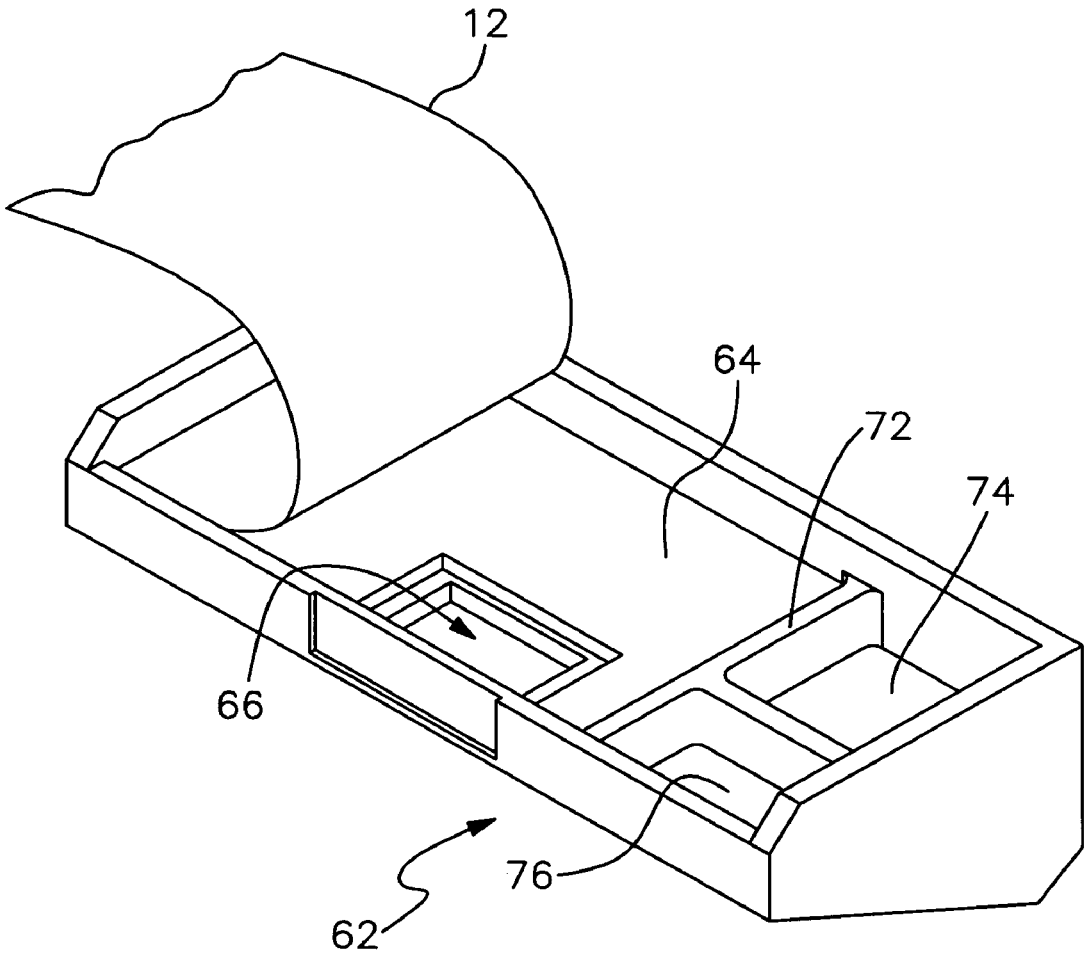
FIG. 6 is a front perspective view of an alternative embodiment of the subject invention with a non-skid top layer being peeled back for illustrative purposes.

FIG. 6 shows an alternative embodiment of the invention described above. Tray 62 includes major portion 64 of the floor having well 66 therein. Well 66 may be embossed or vacuformed. Well 66 is used to mount clip 68 thereon. Clip 68 includes protrusion 70, which is attached to the lower wall of well 66. In FIG. 6, the top surface 12 is shown peeled back so as to illustrate floor 64 and well 66. Barrier 72 is provided between major portion of floor 64 and minor portion of floor 74 so as to readily be able to segregate various musical accessories from one another. In the embodiment of FIG. 6 there is yet another minor floor 76, also having barriers.

Figure 7:
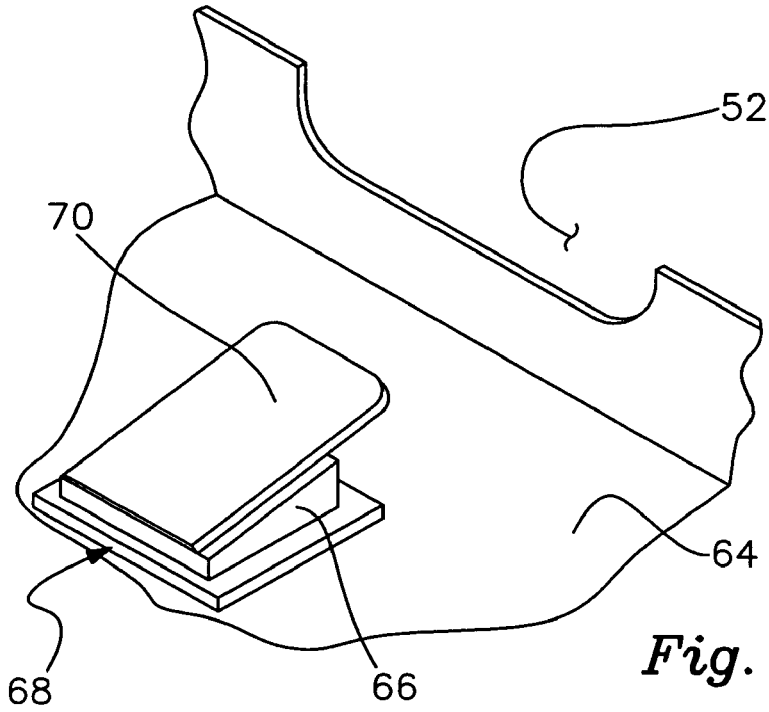
FIG. 7 shows a portion of the bottom of the tray of FIG. 6, particularly illustrating the clip attachment on the bottom.
Figure 8:
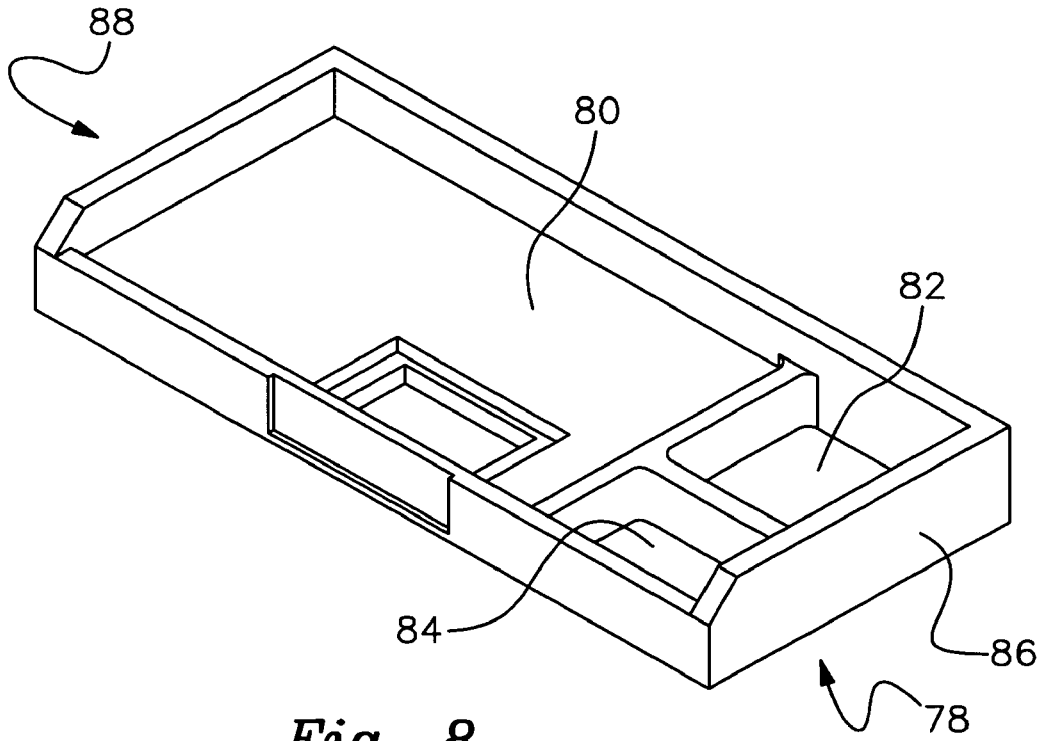
FIG. 8 is a front perspective view of another alternative embodiment of the invention.

FIG. 8 shows another embodiment of this invention which includes tray 78 having level major floor 80 and level minor floors 82 and 84. Thus, the sides 86 and 88 of tray 78 are not wedge shaped. Tray 78 is designed to be placed on top of a portable amplifier which is not tilted. Tray 78 also has a clip which is connected to the bottom of tray 78 in an identical fashion as that shown in FIG. 7.

Figure 9:
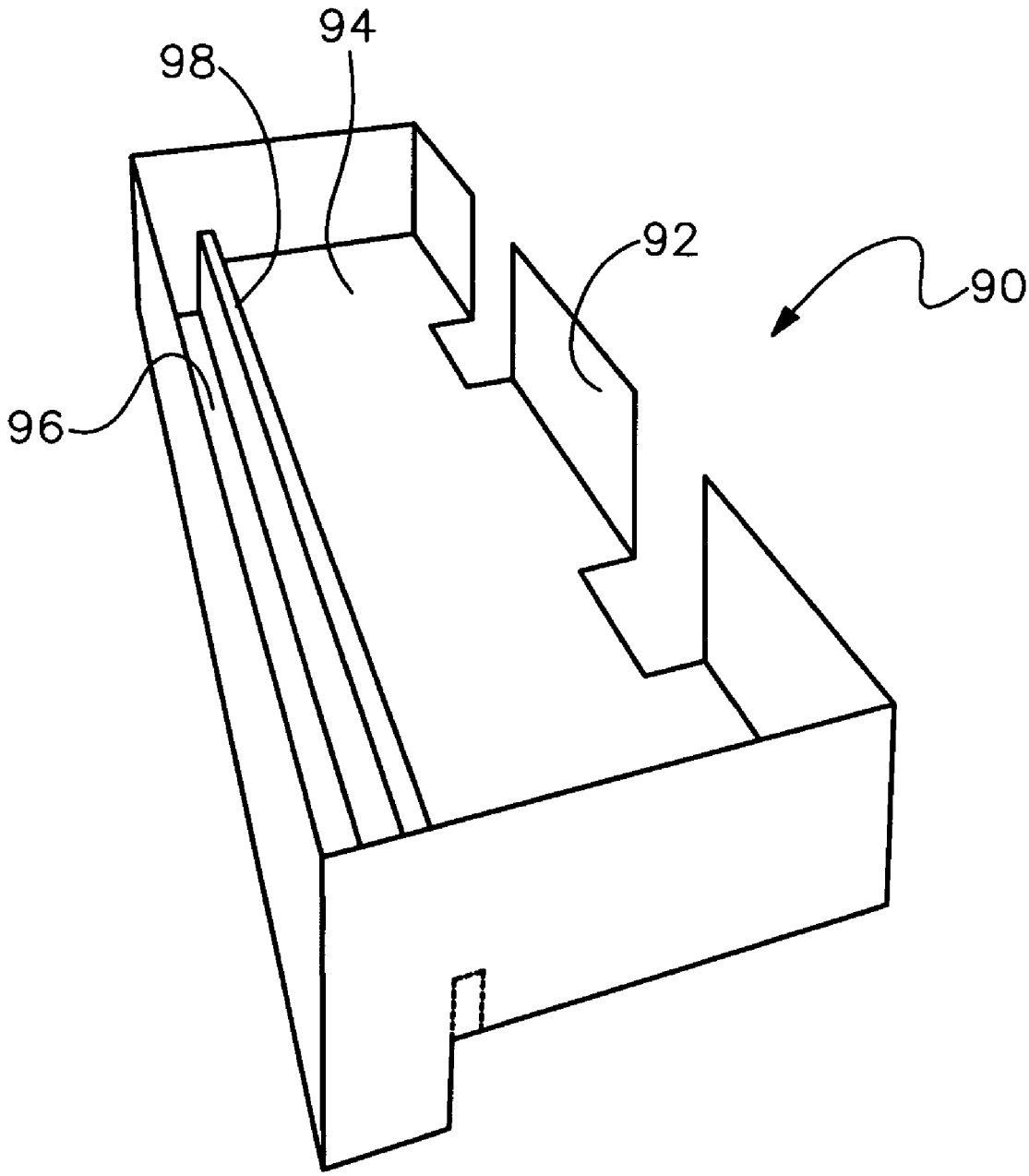
FIG. 9 is a front perspective view of yet another alternative embodiment of the invention.

FIG. 9 illustrates yet another embodiment of the invention. Tray 90 is particularly adapted to rest on the top of an amplifier which is not tilted and which has controls on the top. Element 92 functions as a clip. That is, tray 90 is rotated ninety degrees (90°) and element 92 is placed through loop 54 created by handle 50 of the amplifier as shown in FIG. 5, except that the controls would be on top of the amplifier and would be adjacent to element 92. Tray 90 includes upper surface 94 and lower surface 96, having a barrier 98 there between, also to segregate certain musical accessories from one another.

A tray for receiving musical accessories to be mounted on top of an amplifier is described above. Various details of the invention may be changed without departing from its scope. Furthermore, the foregoing description of embodiments of the invention and the best mode for practicing the invention are provided for the purpose of illustration only and not for the purpose of limitation—the invention being defined by the claims.

The invention claimed is:

1. The combination of a tray and a portable amplifier comprising:

a tray; the tray having a top surface; the top surface of the tray particularly adapted to receive musical accessories;

the tray having at least one rear wall and two side walls; each wall being adjacent to the top surface of the tray; each wall having a bottom edge; each bottom edge extending below the top surface of the tray, forming a cavity;

a clip attached to the tray and received in the cavity; the clip includes a protrusion; the portable amplifier having a top surface; a handle attached to the top surface of the portable amplifier; the handle forming a loop; the clip received in the loop formed by the handle for securing the tray to the top surface of the portable amplifier.

2. The combination as set forth in claim 1 wherein the tray further includes a front wall having a bottom edge; each wall having a top edge; the distance between the top and bottom edges of at least a portion of the rear wall is greater than the distance between the top and bottom edges of the front wall, whereby the tray is wedge shaped.

3. A tray as set forth in claim 1 further including a front wall having a top edge; the distance between the top edge and bottom edge of each wall being substantially equal.

4. The combination as set forth in claim 1 wherein the top surface of the tray has at least first and second portions separated by at least one barrier whereby certain musical accessories may be segregated.

5. The combination as set forth in claim 4 wherein the first portion of the tray is at a different level from the second portion of the tray.

6. The combination as set forth in claim 2 wherein the angle formed by the intersection of the plane of the top surface of the tray and the plane formed by the bottom edges of the walls being at least ten degrees (10°).

7. The combination as set forth in claim 6 wherein the angle is less than forty-five degrees (45°).

8. The combination as set forth in claim 1 wherein the rear wall has a cut-out portion; the cut-out portion aligns with the clip.

9. The combination as set forth in claim 1 wherein the tray has a floor juxtaposed to the top surface of the tray; the clip being attached to the floor.

10. The combination as set forth in claim 9 wherein the protrusion has a free end; the free end extends away from the floor, enabling the protrusion to be more easily received by the loop of the handle of the portable amplifier.

11. The combination of a tray and a portable amplifier comprising:

a tray; the tray having a floor; the floor having a top surface particularly adapted to receive musical accessories;

a plurality of walls extending above the top surface of the floor;

a clip; the clip attached to the floor; the clip including a protrusion; the protrusion extending away from the floor; the portable amplifier having a top surface; a handle attached to the top surface of the portable amplifier; the protrusion received by the handle for securing the tray to the top surface of the portable amplifier.

12. The combination as set forth in claim 11 wherein the top surface of the floor has at least first and second portions separated by a barrier, whereby certain musical accessories may be segregated.

13. The combination as set forth in claim 12 wherein the first portion is at a different level from the second portion.

14. The combination of a tray and a portable amplifier comprising:

a tray; the tray having a floor; a top surface over the floor; the top surface of the tray particularly adapted to receive musical accessories;

the tray having front, rear and two side walls; each wall being adjacent to the top surface of the tray; each side wall having a bottom edge; at least a portion of each bottom edge being parallel to one another; the top surface of the tray not being parallel with the plane formed by the parallel portions of the bottom edges;

a portable amplifier; the portable amplifier being tilted; the portable amplifier having a top surface; the tray being mounted on the top surface of the portable amplifier; the top surface of the tray being substantially level wherein each wall has a bottom edge; the bottom edges extending below the top surface of the tray, forming a cavity; a clip attached to the tray and received in the cavity; a handle attached to the top surface of the portable amplifier; the clip including a protrusion received by the handle of the portable amplifier for securing the tray to the top surface of the portable amplifier.

15. The combination as set forth in claim 14 wherein each side wall has a portion adjacent to the rear wall and a portion adjacent to the front wall; the height of the portion of each side wall adjacent to the rear wall being greater than the height of the portion of each side wall adjacent to the front wall.

16. The combination as set forth in claim 14 wherein each wall has a top edge; the distance between the top and bottom edges of at least a portion of the rear wall is greater than the distance between the top and bottom edges of the front wall, whereby the tray is wedge shaped.

17. The combination as set forth in claim 14 wherein the top surface of the tray has at least first and second portions separated by at least one barrier, whereby certain musical accessories may be segregated.

18. The combination as set forth in claim 17 wherein the first portion is at a different level from the second portion.

19. The combination as set forth in claim 14 wherein the angle formed by the intersection of the plane of the top surface of the tray and the plane formed by the bottom edges of the walls are between ten degrees (10°) and forty-five degrees (45°).

20. The combination as set forth in claim 14 wherein the rear wall has a cut-out portion; the cut-out portion aligning with the clip.

21. The combination as set forth in claim 14 wherein the tray has a floor juxtaposed to the top surface of the tray; the clip attached to the floor; the protrusion having a free end; the free end extending away from the floor, enabling the protrusion to be more easily received in the handle of the portable amplifier.

22. A tray as set forth in claim 14 wherein the floor has a well extending downwardly therefrom; the clip attached to said well.

23. The combination as set forth in claim 14 wherein said top surface of the tray is formed from a layer of material received over at least a portion of the floor.

* * * * *